US006761678B1

(12) United States Patent
Miescher et al.

(10) Patent No.: US 6,761,678 B1
(45) Date of Patent: Jul. 13, 2004

(54) FOLDING CYLINDER WITH EXPANSION PLATE

(75) Inventors: Christian Heinz Miescher, Newburgport, MA (US); (Ric) Alberic Ouellette, Alton Bay, NH (US); Dwight Douglas Cormier, Farmingon, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 260 days.

(21) Appl. No.: 09/571,606

(22) Filed: May 15, 2000

(51) Int. Cl.[7] ..... B31F 1/10

(52) U.S. Cl. ..... 493/434; 493/425; 493/424; 493/426

(58) Field of Search ..... 493/434, 425, 493/476, 424, 426, 427, 429

(56) References Cited

U.S. PATENT DOCUMENTS

| | | | | |
|---|---|---|---|---|
| 2,555,267 A | * | 5/1951 | Crafts | |
| 3,477,709 A | * | 11/1969 | Neal et al. | |
| 4,936,561 A | * | 6/1990 | Mukai | 493/476 |
| 5,039,076 A | | 8/1991 | Fischer | 270/47 |
| 5,122,109 A | | 6/1992 | Kubota et al. | 493/427 |
| 5,201,701 A | | 4/1993 | Roettger et al. | 493/425 |
| 5,846,177 A | | 12/1998 | Mayr | 493/424 |

FOREIGN PATENT DOCUMENTS

| | | |
|---|---|---|
| EP | 0436908 | 7/1994 |
| GB | 1003717 | 9/1965 |
| GB | 1203114 | 8/1970 |

OTHER PUBLICATIONS

*Newspaper Presses*, Braasch, William, American Newspaper Publishing Assoc. (Feb. 1958), pp. 136–154.

* cited by examiner

*Primary Examiner*—Mickey Yu
*Assistant Examiner*—Sameh Tawfik
(74) *Attorney, Agent, or Firm*—Davidson, Davidson & Kappel, LLC

(57) ABSTRACT

A rotary blade folder includes two fold rollers and a folding cylinder, the folding cylinder including a cylinder body with an outer surface, a set of tucking blades and an expansion plate adjustable to change an effective diameter of the folding cylinder. The expansion plate has at least one aperture, the set of tucking blades fitting through the at least one aperture during a tucking operation so as to present a fold in a signature to the two fold rollers. Also provided is a method of folding a signature comprising the steps of gripping a signature about a folding cylinder so that the signature is over an expansion plate of the folding cylinder, the expansion plate having at least one aperture, and folding the signature by passing tucking blades through the at least one aperture.

3 Claims, 3 Drawing Sheets

FOLDING CYLINDER WITH EXPANSION PLATE

BACKGROUND OF THE INVENTION

1. Field of the Invention

The present invention relates generally to printing presses and more particularly to a folder of a printing press.

2. Background Information

Web printing presses print a continuous web of material, such as paper. In a folder of the printing press, the continuous web then is cut into signatures in a cutting unit and folded.

One way to fold the resulting signatures is using a rotary blade folder, which includes a folding cylinder with tucker blades which provide a fold to the signature. The fold is forced by the tucker blade toward two rotating fold rolls, which grip the signature along the fold at a nip, set the fold and deliver the folded product, for example, to a fan unit.

Chapter 6 (pages 136 to 154) of the book "Newspaper Presses" by William Braasch describes the two basic kinds of rotary blade folders: 2 to 1 folders and 3 to 2 folders. In a 2 to 1 rotary blade folder, two sets of tucker blades are spaced 180 degrees apart on the folding cylinder. A signature is held by pins spaced 90 degrees ahead of a tucker blade set and when the signature midpoint reaches the fold rollers, the tucker blade pushes the signature at the midpoint into the fold rollers so as to form the fold. Thus in a 2 to 1 folder, two sets of pins spaced 180 degrees apart are present, for holding edges of the products to be folded. In a 3 to 2 folder, three sets of pins spaced 120 degrees apart are present. Sets of tucker blades operate at a midpoint of a signature to produce a fold by pushing the midpoint into a pair of fold rollers.

Each set of tucking blades has a plurality of blades which must extend beyond the surface of the cylinder to produce the fold, and then retract to pass by the fold rollers. The blades of each set are spaced axially apart, and there can be, for example, four blades spaced axially along the folding cylinder. In order to provide for proper support of the signature to be folded on the folding cylinder, bands are located between the tucking blades so as to complete the circumference of the folding cylinder. For example, five bands can be spaced apart, with the tucking blades emerging through the bands. The bands can be adjusted to change an effective diameter of the folding cylinder to accommodate, for example, different signature thicknesses.

In, for example, the N1600 3 to 2 collect folder manufactured by Heidelberg Web Systems, Inc., the bands are attached to a block mechanism which can be adjusted by a motor. Each band is adjustable on the block mechanism to accommodate for differences between the bands and to provide for individual adjustment of each band.

However, adjusting the individual bands is difficult, time-consuming and can result in extensive work to achieve proper positioning of all of the bands. The adjustment mechanisms also may be prone to failure. Moreover, the single bands can collapse, causing malfunction of the folding cylinder.

BRIEF SUMMARY OF THE INVENTION

An object of the present invention is to provide for a folding cylinder with a variable diameter which has improved strength. An additional or alternative object of the present invention is to provide a folding cylinder with an easily-adjustable variable diameter.

The present invention provides a rotary blade folder comprising two folding rollers and a folding cylinder having a cylinder body, a set of tucking blades and an expansion plate adjustable to change an effective diameter of the folding cylinder, the expansion plate having at least one aperture, the tucking blades fitting through the at least one aperture during a tucking operation so as to present a fold in a signature to the two folding rollers.

The expansion plate provides a stronger outer cylinder surface around the tucking blades, requires less assembly, and is easier to adjust. The plate also reduces air circulation and vacuum effects in the folding cylinder that can cause fold inaccuracies.

Preferably, the expansion plate is connected to the cylinder body at one edge by a pivot, and is connected to an actuating rod at another end. The actuating rod may be controlled by a motor to set the effective diameter.

Preferably, at least two sets of tucking blades are present, spaced evenly circumferentially about the folding cylinder, and at least two expansion plates are provided, one for each set of tucking blades.

The expansion plate preferably is made of spring steel, and may be of a grid construction for easier adjustment.

The present invention also provides a folding cylinder having a cylinder body, tucking blades and an expansion plate connected to an outer surface of the cylinder body and adjustable to change an effective diameter of the folding cylinder, the expansion plate having at least one aperture, the tucking blades fitting through the at least one aperture during a tucking operation so as to fold a signature.

The present invention also provides a method of folding a signature comprising the steps of:

gripping a signature about a folding cylinder so that the signature is over an expansion plate of the folding cylinder, the expansion plate having at least one aperture; and folding the signature by passing tucking blades through the at least one aperture.

The method preferably includes passing a fold in the signature to two folding rolls to set the fold.

Preferably, the method also includes the step of adjusting the expansion plate as a function of a thickness of the signature. The adjusting step can include pivoting the expansion plate about a pivot. The pivoting can occur using a moving block mechanism, with the pivot at one edge of the expansion plate and the moving block mechanism at the other end. The block can be moved by a motor to set the proper effective diameter of the folding cylinder.

BRIEF DESCRIPTION OF THE DRAWINGS

A preferred embodiment of the present invention is described below by reference to the following drawings, in which.

DETAILED DESCRIPTION

Figure 1:
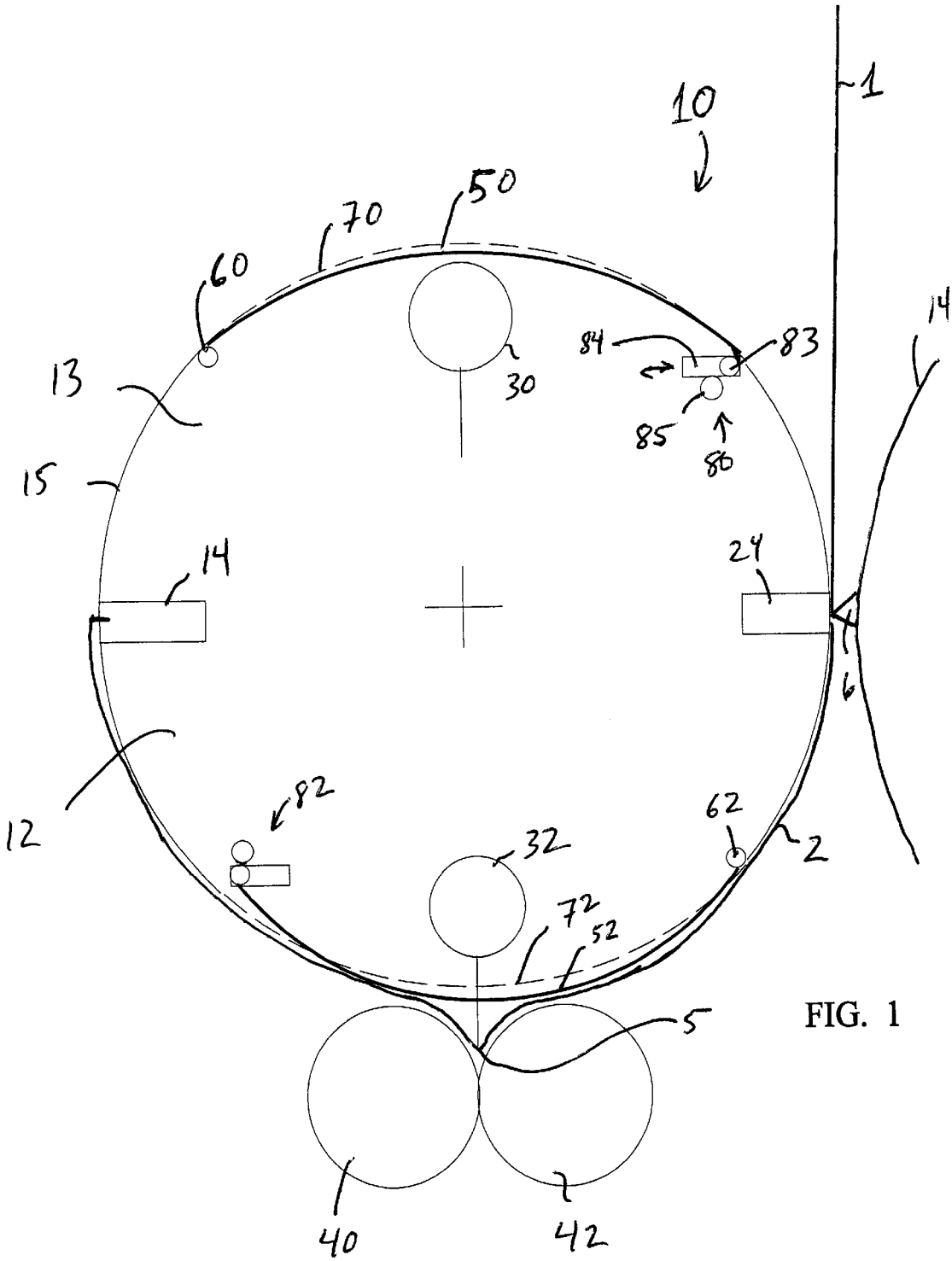
FIG. 1 shows a schematic side view of a 2 to 1 rotary blade folder of the present invention.

FIG. 1 shows a schematic side view of a rotary blade folder 10, which includes a folding cylinder 12 and cutting cylinder 14. Attached to a cylinder body 13 of cylinder 12 are two anvil and pin combinations 14, 24. Anvil and pin combinations 14, 24 each include a cutting rubber for a blade 6 of cutting cylinder 14 and a pin for holding a lead edge of a signature 2 cut from a web 1. The cylinder body 13 also supports two sets of tucker blades 30, 32. Folder 10 also includes two fold rolls 40, 42 for accepting a fold 5 of signature 2 and transporting signature 2 through the folder 10. Signature 2 preferably is a newspaper.

Cylinder 12 also includes two expansion plates 50, 52, one for each tucker blade set 30, 32. Expansion plates 50, 52 are rotatable at one edge about fixed pivots 60, 62, and are movable at opposing edges by setting devices 80, 82, respectively. Setting device 80 includes a pin 83, a movable block 84 in which pin 83 is connected, and a drive 85. Setting device 82 is of similar construction. As will be described, setting device 80 can be used to set an effective diameter of cylinder 12 by moving the connecting edge of expansion plate 50.

As shown with expansion plate 50, setting device 80 in is an outward position where, expansion plate 50 is inside true diameter 70 of cylinder 12. Setting mechanism 82 is shown in an inward position where expansion plate 52 is forced to bend outside true diameter 72 of cylinder 12. These two different positions are shown with plates 50, 52 for descriptive purposes only. In actual operation, rather than the different effective diameters as shown in FIG. 1, both expansion plates 50, 52 typically will be set to a similar effective diameter as a function of the thickness of the signature to be folded.

Figure 2:
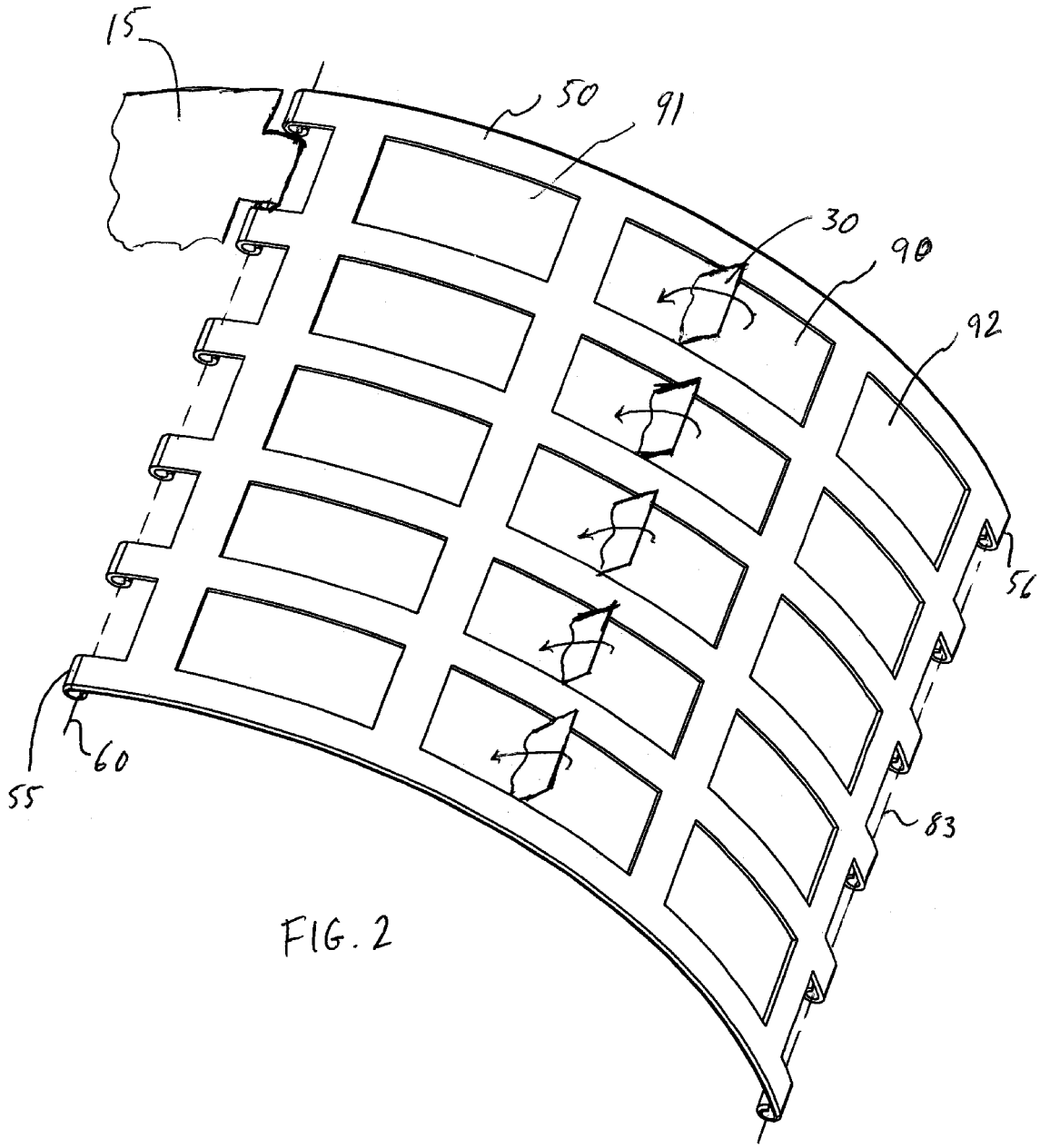
FIG. 2 shows an expansion plate for a rotary blade folder according to the present invention.

As shown in more detail in FIG. 2, expansion plate 50 is rotatable about pivot 60 (shown schematically by a dashed line) at edge 55. Fixed pivot 60 may be a pin which fit through curved edge 55 and is attached to cylinder body 13, for example with similar curved edges at an outer surface 15 of cylinder body 13, as shown partially in FIG. 2 as well. A rod 83 of the setting mechanism 80 can pass through a second edge 56 of plate 50, so that edge 56 is rotatable with respect to rod 83.

Figure 3:
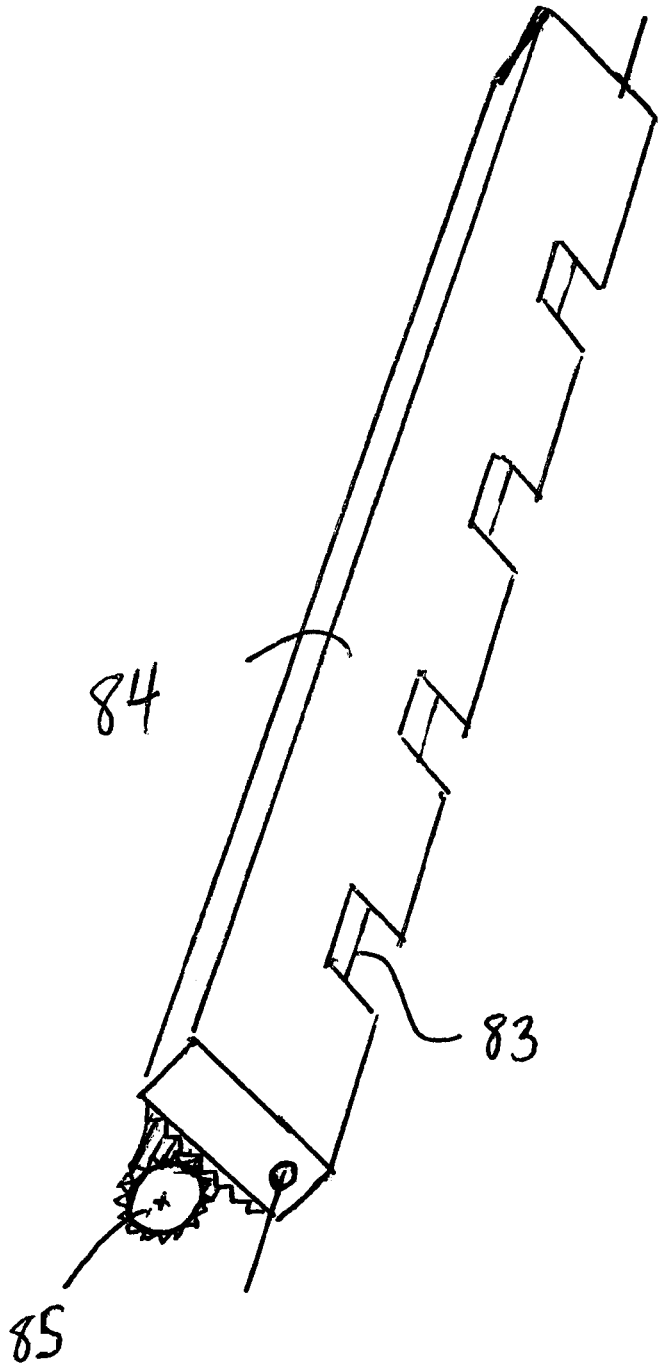
FIG. 3 shows a setting device of the rotary blade folder according to the present invention.

Rod 83 also passes through block 84, to which it may be fixed, as shown in FIG. 3. Block 84 may have a toothed lower surface, and can be moved back and forth by drive 85, which may comprise a gear for interacting with the toothed surface, the gear being connected to a motor. It is noted that other mechanisms for moving edge 56 also are within the scope of the present invention.

Plate 50 is made of spring steel, and has a central row of apertures 90, through which axially-spaced blades 30 can emerge and retract to fold a signature. Plate 50 may have side holes 91, 92 which are not absolutely necessary, but are preferable to make the bending of plate 50 easier and to provide improved air flow. Plate 52 has a similar construction.

The effective diameter of cylinder 12 can be set to provide for optimal folding, without having to adjust individual bands. Setting mechanisms 80, 82 are set to move the connected edges of the plates 50, 52, respectively. The setting preferably is a function of the thickness of the signature to be folded.

As a midpoint of signature 2 reaches fold rollers 40, 42, blades 32 emerge from the center apertures of the folding plate 52 and form a fold 5, which is accepted by the fold rollers 40, 42 and passes through a nip in those rollers.

It should be noted that the present invention is equally applicable to 3 to 2 rotary blade folders as to 2 to 1. In the case of a 3 to 2 folder, typically only one expansion plate is necessary.

Each plate 50, 52 preferably extends between 30 and 90 degrees about cylinder 12, most preferably about 60 degrees.

The terms folding rolls and fold rollers are used interchangeable herein.

What is claimed is:

1. A rotary blade folder comprising:

two fold rollers; and a folding cylinder, the folding cylinder including:

a cylinder body with an outer surface, a set of tucking blades, the set of tucking blades being spaced axially apart from each other, an expansion plate adjustable to change an effective diameter of the folding cylinder, the expansion plate having a plurality of apertures spaced axially next to each other, the set of tucking blades fitting through the plurality of apertures during a tucking operation so as to present a fold in a signature to the two fold rollers, the expansion plate having an edge, and a rod connecting the edge to the cylinder body, the rod extending axially past at least two of the plurality of apertures.

2. The rotary blade folder as recited in claim 1 wherein the edge is a curved edge.

3. A rotary blade folder comprising:

two fold rollers; and a folding cylinder, the folding cylinder including:

a cylinder body with an outer surface, a set of tucking blades, the set of tucking blades being spaced axially apart from each other, a grid-shaped expansion plate adjustable to change an effective diameter of the folding cylinder, the expansion plate having a first plurality of apertures spaced axially next to each other and a second plurality of apertures spaced axially next to each other and circumferentially spaced from the first plurality of apertures, the set of tucking blades fitting through the first plurality of apertures during a tucking operation so as to present a fold in a signature to the two fold rollers.

* * * * *